US007935032B1

(12) United States Patent
Jackson

(10) Patent No.: US 7,935,032 B1
(45) Date of Patent: May 3, 2011

(54) EXERCISE SYSTEM

(76) Inventor: Robert A. Jackson, Moses Lake, WA (US)

( * ) Notice: Subject to any disclaimer, the term of this patent is extended or adjusted under 35 U.S.C. 154(b) by 0 days.

(21) Appl. No.: 12/639,551

(22) Filed: Dec. 16, 2009

(51) Int. Cl.
*A63B 21/00* (2006.01)

(52) U.S. Cl. ..... 482/70; 482/71; 482/74

(58) Field of Classification Search ..... 482/70, 482/71, 72, 74, 75, 52, 54
See application file for complete search history.

(56) References Cited

U.S. PATENT DOCUMENTS

| | | | | |
|---|---|---|---|---|
| 4,340,214 | A * | 7/1982 | Schutzer | 482/51 |
| 4,744,557 | A | 5/1988 | Smirmaul | |
| 5,232,423 | A | 8/1993 | Hajduczek | |
| 5,575,740 | A * | 11/1996 | Piaget et al. | 482/70 |
| 5,582,567 | A | 12/1996 | Chang | |
| 5,718,658 | A | 2/1998 | Miller et al. | |
| 6,231,484 | B1 | 5/2001 | Gordon | |
| 6,368,254 | B1 * | 4/2002 | Wall | 482/71 |
| 6,786,850 | B2 | 9/2004 | Nizamuddin | |
| 2004/0242381 | A1 * | 12/2004 | Parmater | 482/71 |

* cited by examiner

*Primary Examiner* — Jerome W Donnelly
(74) *Attorney, Agent, or Firm* — Neustel Law Offices

(57) ABSTRACT

An exercise system for simulating the motions involved in boarding sports such as surfing or snowboarding in a repetitive manner which allows for a cardiovascular, aerobic exercise that builds and tones the same muscles and reflexes used in boarding sports. The exercise system generally includes a frame including a first track and a second track. The first track is positioned parallel with the second track. A carriage assembly is slidably mounted on the first track and the second track such that the carriage assembly may freely slide back and forth along the tracks. The carriage assembly is adapted to tilt about a horizontal axis of rotation and swivel about a vertical axis of rotation. By sliding the carriage assembly along the tracks and utilizing the swiveling and tilting motions, the operator may simulate the motions and exercises encountered while enjoying boarding sports such as wakeboarding, snowboarding, surfing and skateboarding.

20 Claims, 9 Drawing Sheets

EXERCISE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to exercise machines and more specifically it relates to an exercise system for simulating the motions involved in boarding sports such as snowboarding in a repetitive manner which allows for a cardiovascular, aerobic exercise that builds and tones the same muscles and reflexes used in boarding sports.

2. Description of the Related Art

Any discussion of the related art throughout the specification should in no way be considered as an admission that such related art is widely known or forms part of common general knowledge in the field.

Exercise machines designed for home use have been utilized by individuals for years. Previously existing exercise machines designed for home use have been produced in a wide variety of configurations, including treadmills, exercise bikes, elliptical machines, incline trainers and the like. Additionally, a number of exercise machines have been designed with individuals who enjoy "boarding sports" such as snowboarding, surfing, wakeboarding, skateboarding, windsurfing and kiteboarding in mind.

Previously existing exercise machines which are designed to simulate motions encountered in "boarding sports" have both failed to properly simulate such motions as well as failed to target the specific muscles and body areas which need development to excel at such sports. Boarding exercise machines are generally comprised of a simple parallel track design with a simple foot platform which slides forward and backward on the track without any pivoting or tilting motions. While such boarding exercise machines appear to provide muscle toning, the absence of pivoting or tilting motions in the foot platform leaves a number of muscles and body areas which are important to boarding sports without any toning or exercise.

Because of the inherent problems with the related art, there is a need for a new and improved exercise system for simulating the motions involved in boarding sports such as surfing or snowboarding in a repetitive manner which allows for a cardiovascular, aerobic exercise that builds and tones the same muscles and reflexes used in boarding sports.

BRIEF SUMMARY OF THE INVENTION

A system for simulating the motions involved in boarding sports such as snowboarding in a repetitive manner which allows for a cardiovascular, aerobic exercise that builds and tones the same muscles and reflexes used in boarding sports. The invention generally relates to an exercise system which includes a frame including a first track and a second track. The first track is positioned parallel with the second track. A carriage assembly is slidably mounted on the first track and the second track such that the carriage assembly may freely slide back and forth along the tracks. The carriage assembly is adapted to tilt about a horizontal axis of rotation and swivel about a vertical axis of rotation. By sliding the carriage assembly along the tracks and utilizing the swiveling and tilting motions, the operator may simulate the motions and exercises encountered while enjoying boarding sports such as wakeboarding, snowboarding, surfing, windsurfing, kiteboarding and skateboarding.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
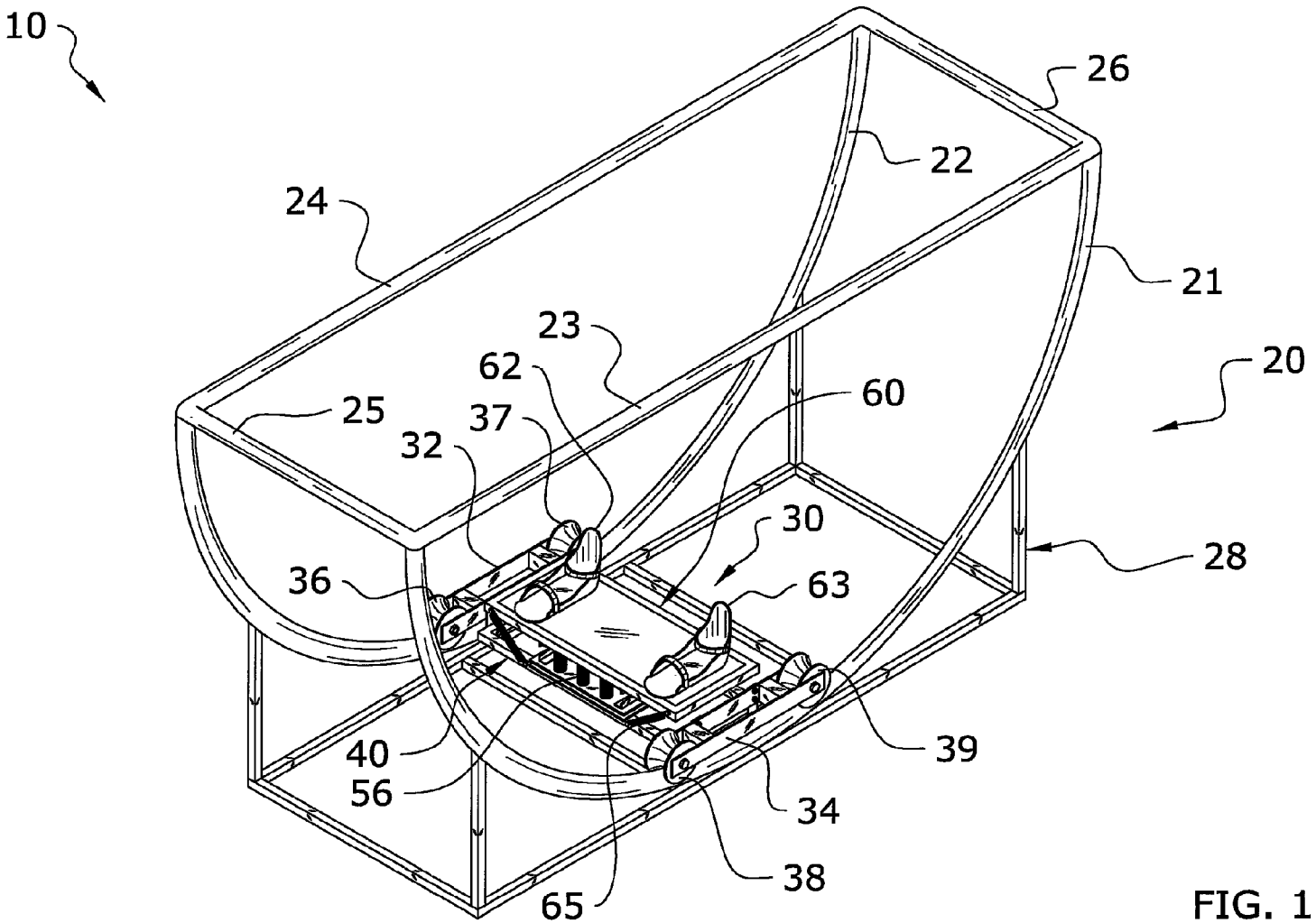
FIG. 1 is an upper perspective view of the present invention.

Turning now descriptively to the drawings, in which similar reference characters denote similar elements throughout the several views, FIGS. 1 through 9 illustrate an exercise system 10, which comprises a frame 20 including a first track 21 and a second track 22. The first track 21 is positioned parallel with the second track 22. A carriage assembly 30 is slidably mounted on the first track 21 and the second track 22 such that the carriage assembly 30 may freely slide back and forth along the tracks 21, 22. The carriage assembly 30 is adapted to tilt about a horizontal axis of rotation and swivel about a vertical axis of rotation. By sliding the carriage assembly 30 along the tracks 21, 22 and utilizing the swiveling and tilting motions, the operator may simulate the motions and exercises encountered while enjoying boarding sports such as snowboarding, surfing, wakeboarding, kiteboarding, windsurfing and skateboarding.

B. Frame

Figure 5:
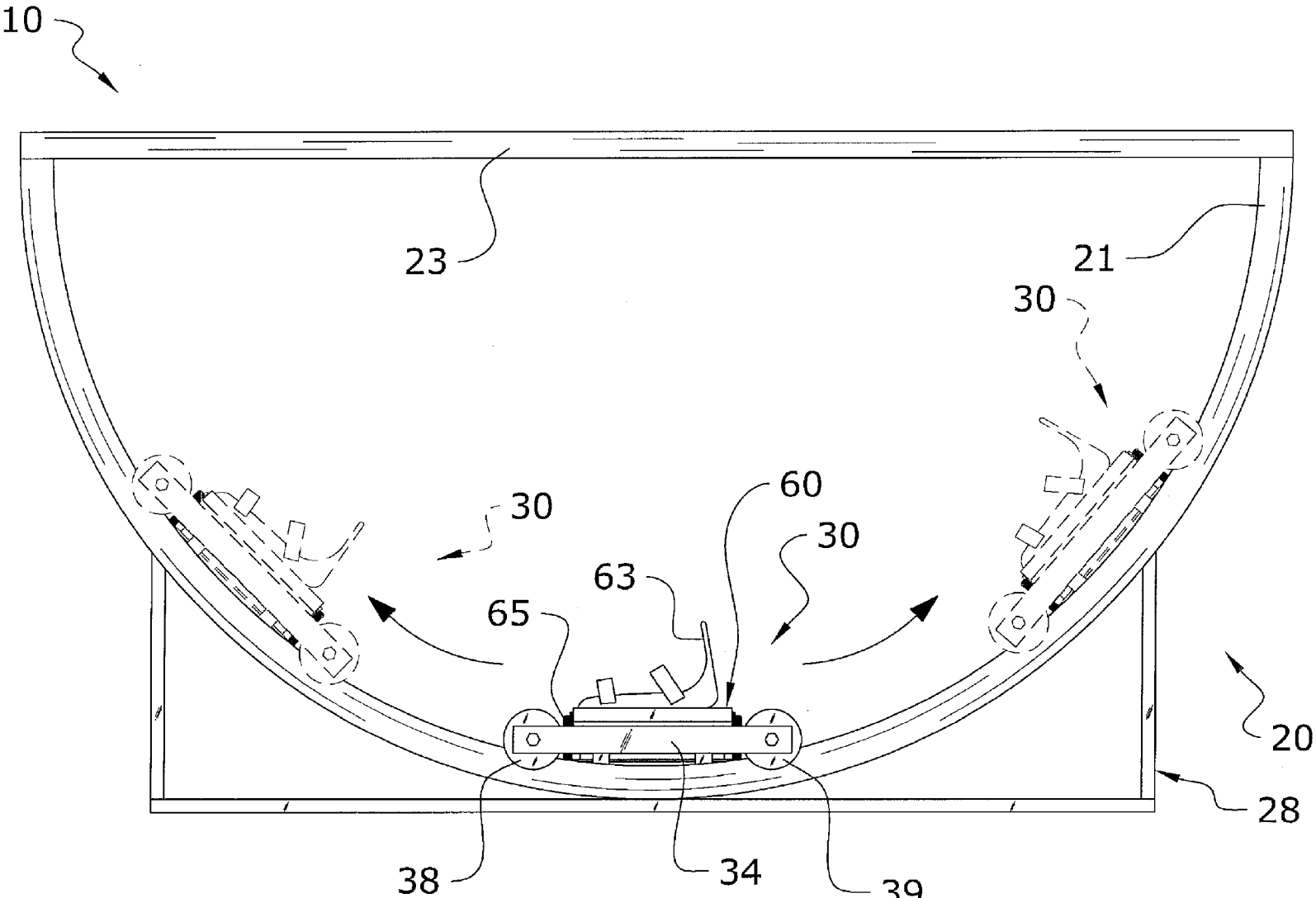
FIG. 5 is a side view of the present invention in use.

The present invention will generally include a frame 20 on which the carriage assembly 30 of the present invention may be slidably mounted. The frame 20 will generally include at least one track on which a carriage assembly 30 may be slidably mounted. In a preferred embodiment, the at least one track is comprised of a first track 21 and second track 22 positioned parallel to each other. The first track 21 and second track 22 will each generally be comprised of a curved, concave tracking which includes a first upper end and a second upper end linked by a track midsection. The track midsection of the tracks 21, 22 will generally be positioned at a low point near the ground with the first upper end and second upper end extending upwardly in a curved manner from the track midsection as shown in FIG. 1. Such a configuration allows the carriage assembly 30 to freely travel up toward the first upper end and then back down past the track midsection and up toward the second upper end in a path similar to that taken by a pendulum as is illustrated in FIG. 5.

The first track 21 and second track 22 may be comprised of various configurations, but will preferably be comprised of smooth, curved, concave railing onto which the carriage assembly 30 of the present invention may be mounted and freely slid upon. The tracks 21, 22 may be comprised of various cross-sections, though in a preferred embodiment a substantially circular cross-section will be utilized. Further, although it is preferable that the first track 21 be substantially the same shape and size as the second track 22, it is appreciated that in some embodiments the tracks 21, 22 may differ in shape and/or size so long as the carriage assembly 30 is able to freely traverse the tracks 21, 22.

The respective upper ends of the first track 21 and the second track 22 will generally be connected to each other by a first linkage support 25 and second linkage support 26 as shown in FIG. 1. Preferably, the first upper end of the first track 21 will be connected to the first upper end of the second track 21 by the first linkage support 25 and the second upper end of the second track 21 will be connected to the second upper end of the second track 22 by the second linkage support 26. The first linkage support 25 and second linkage support 26 maintain the first track 21 and second track 22 at an equal distance from each other and improve stability of the frame 20.

The frame 20 will also generally include a pair of handrails 23, 24 for allowing an operator of the present invention to rest his/her hands while the invention is in use. The handrails 23, 24 also provide a grasping point which assists the operator in exerting the forces necessary to traverse the tracks 21, 22 with the carriage assembly 30. The first handrail 23 will generally be comprised of an elongated, rigid member which links the first upper end and the second upper end of the first track 21 as shown in FIG. 1. The second handrail 24 will generally be comprised of a similar elongated, rigid member which links the first upper and the second upper end of the second track 22. It is also appreciated that the handrails 23, 24 and linkage supports 25, 26 will generally be interconnected in a rectangular configuration as shown in FIG. 1.

Figure 2:
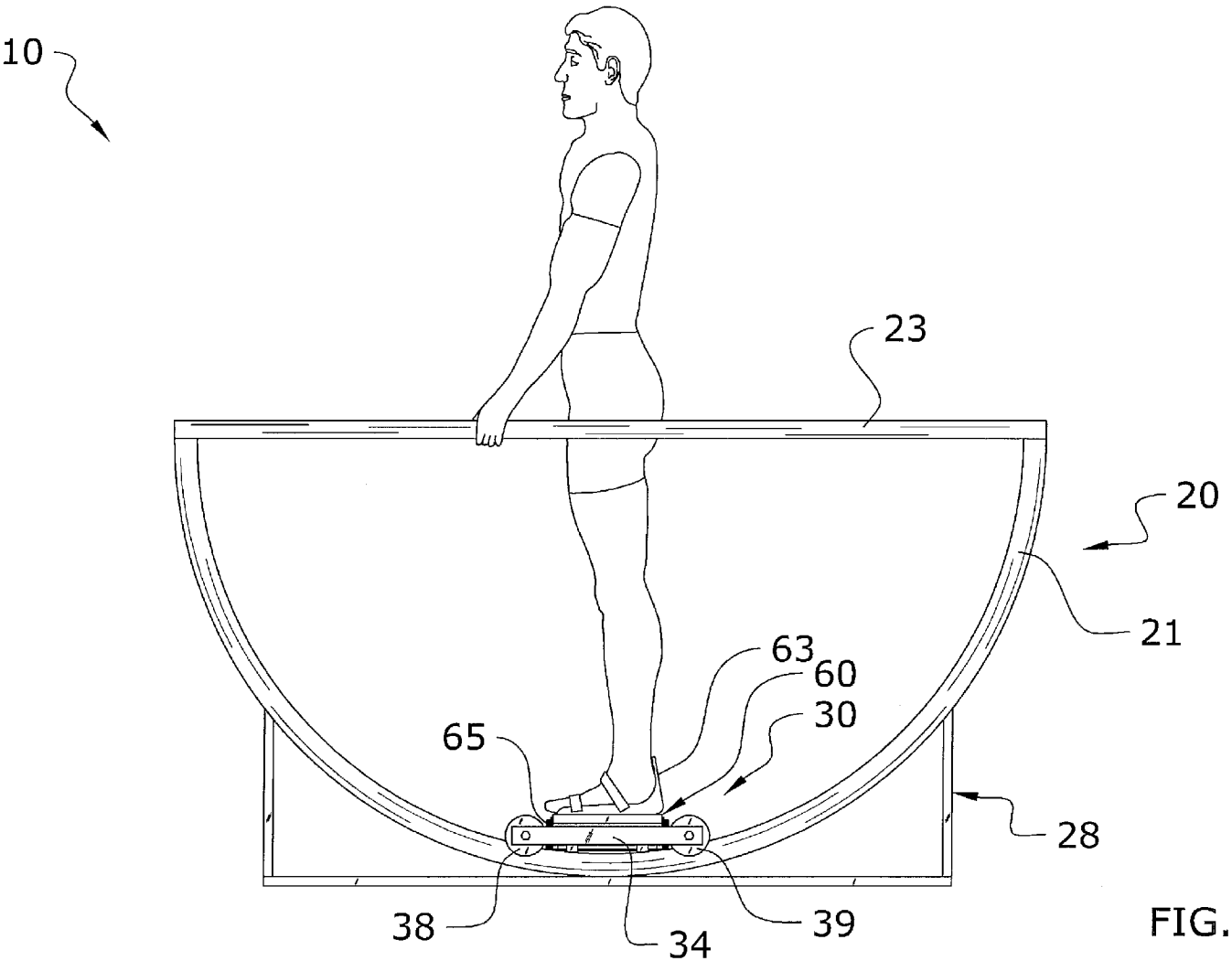
FIG. 2 is a side view of the present invention.
Figure 3:
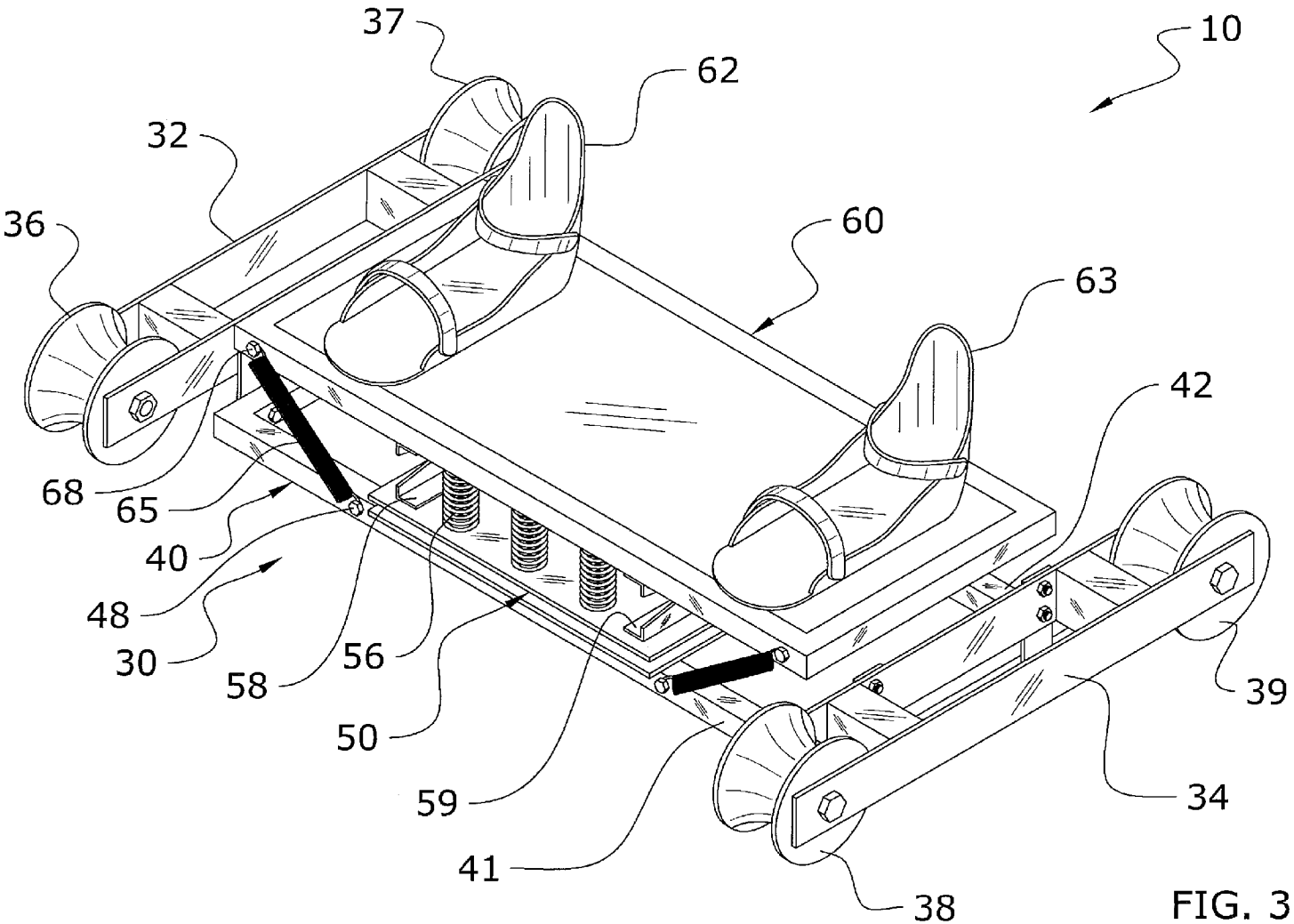
FIG. 3 is an upper perspective view of the carriage assembly of the present invention.

The frame 20 will generally be maintained in an upright position on the ground by a base support 28 as shown in FIG. 2. The base support 28 may be comprised of any configuration which allows the frame 20 to freely stand on level ground without the need for outside support beams, ropes and the like. In a preferred embodiment as shown in FIG. 1, the base support 28 may be comprised of a rectangular frame onto which the first track 21 and second track 22 may be fixedly mounted.

C. Carriage Assembly

Figure 6:
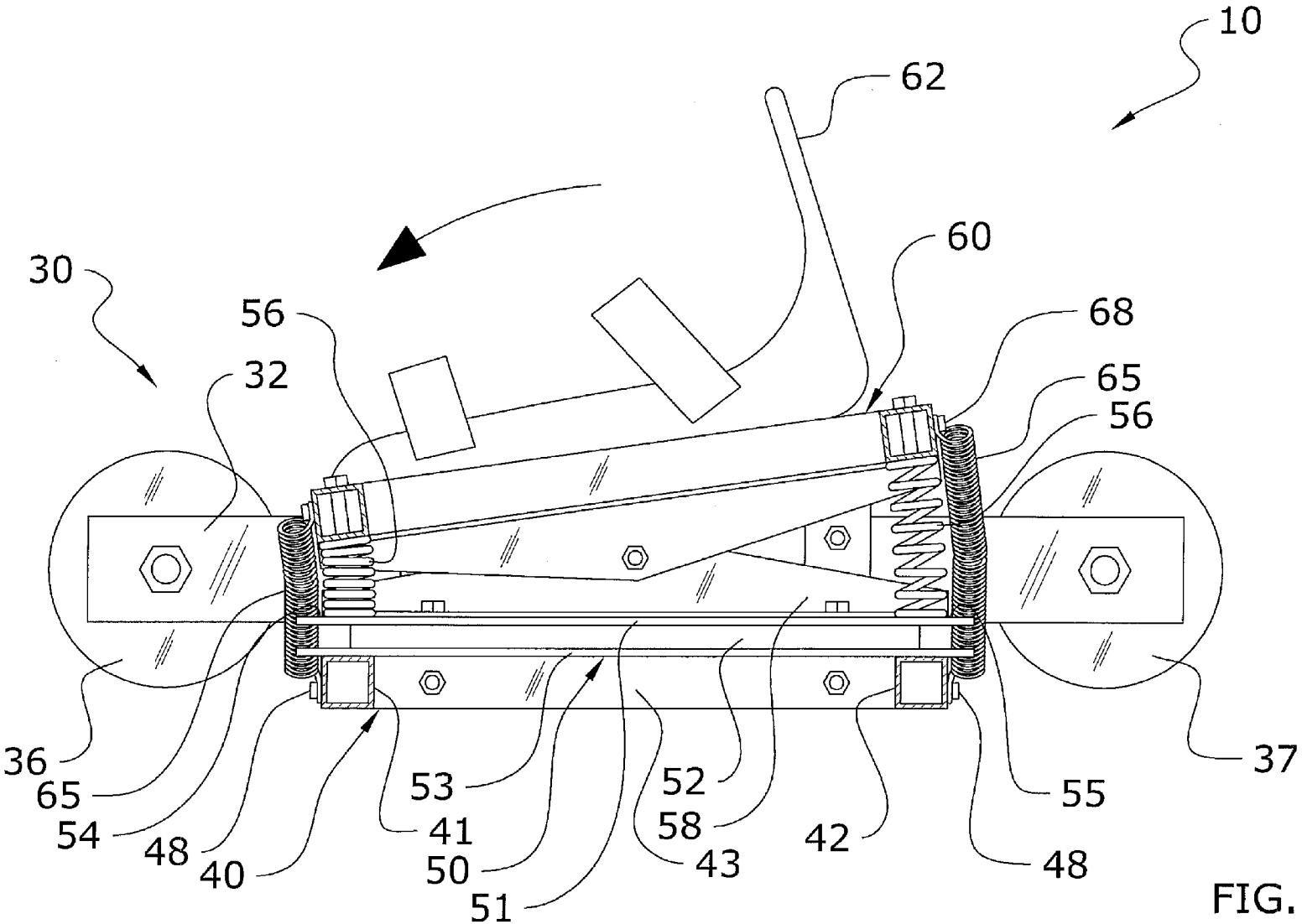
FIG. 6 is a side view of the carriage assembly of the present invention illustrating its tilting motion.
Figure 7:
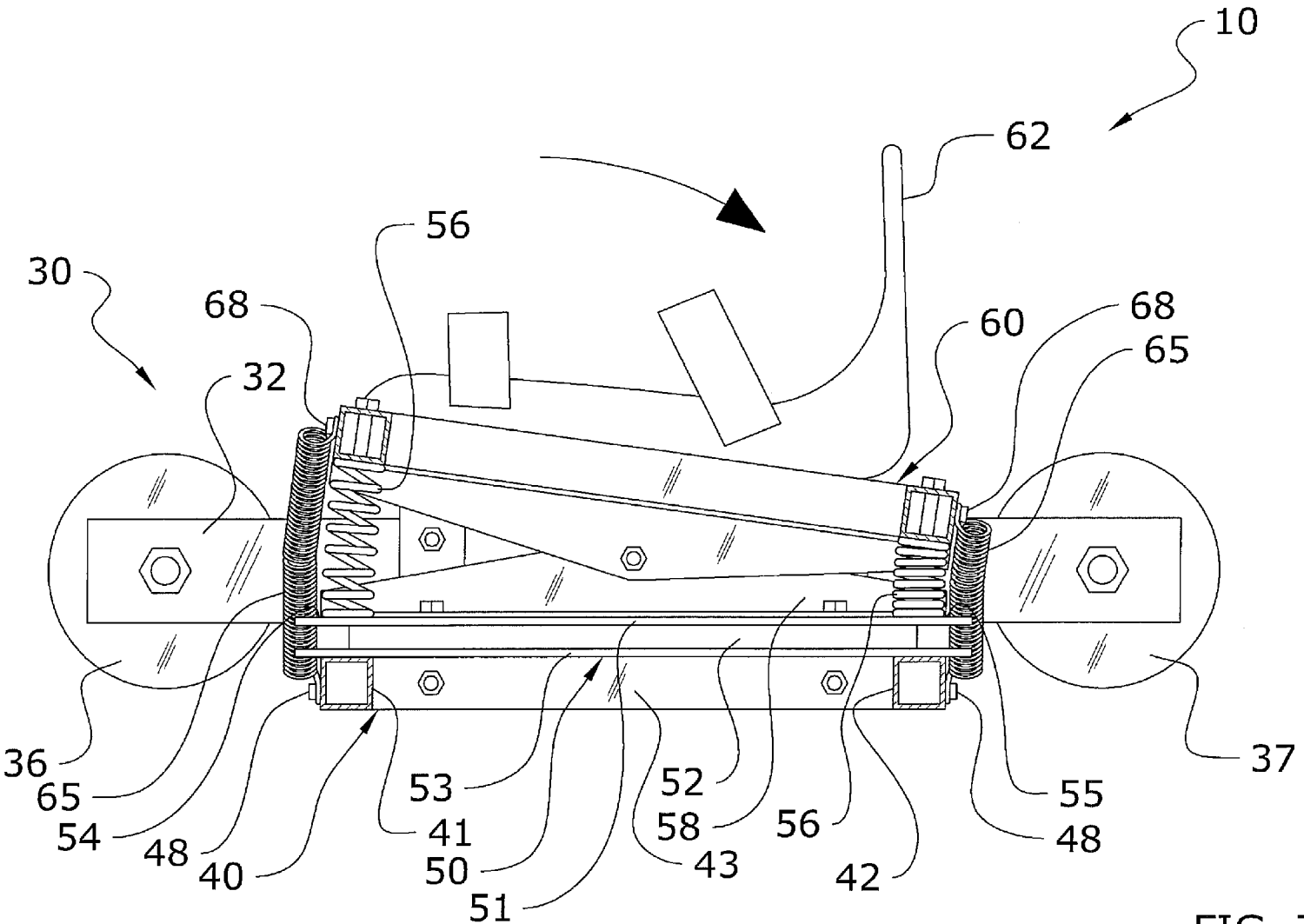
FIG. 7 is a side view of the carriage assembly of the present invention illustrating its tilting motion.

The present invention will generally include a carriage assembly 30 which is slidably mounted to the frame 20 and will generally straddle both the first track 21 and the second track 22. The carriage assembly 30 will preferably be capable of freely tilting in a first direction and a second direction about a horizontal axis of rotation, such as forward and backward as shown in FIGS. 6 and 7.

Figure 8:
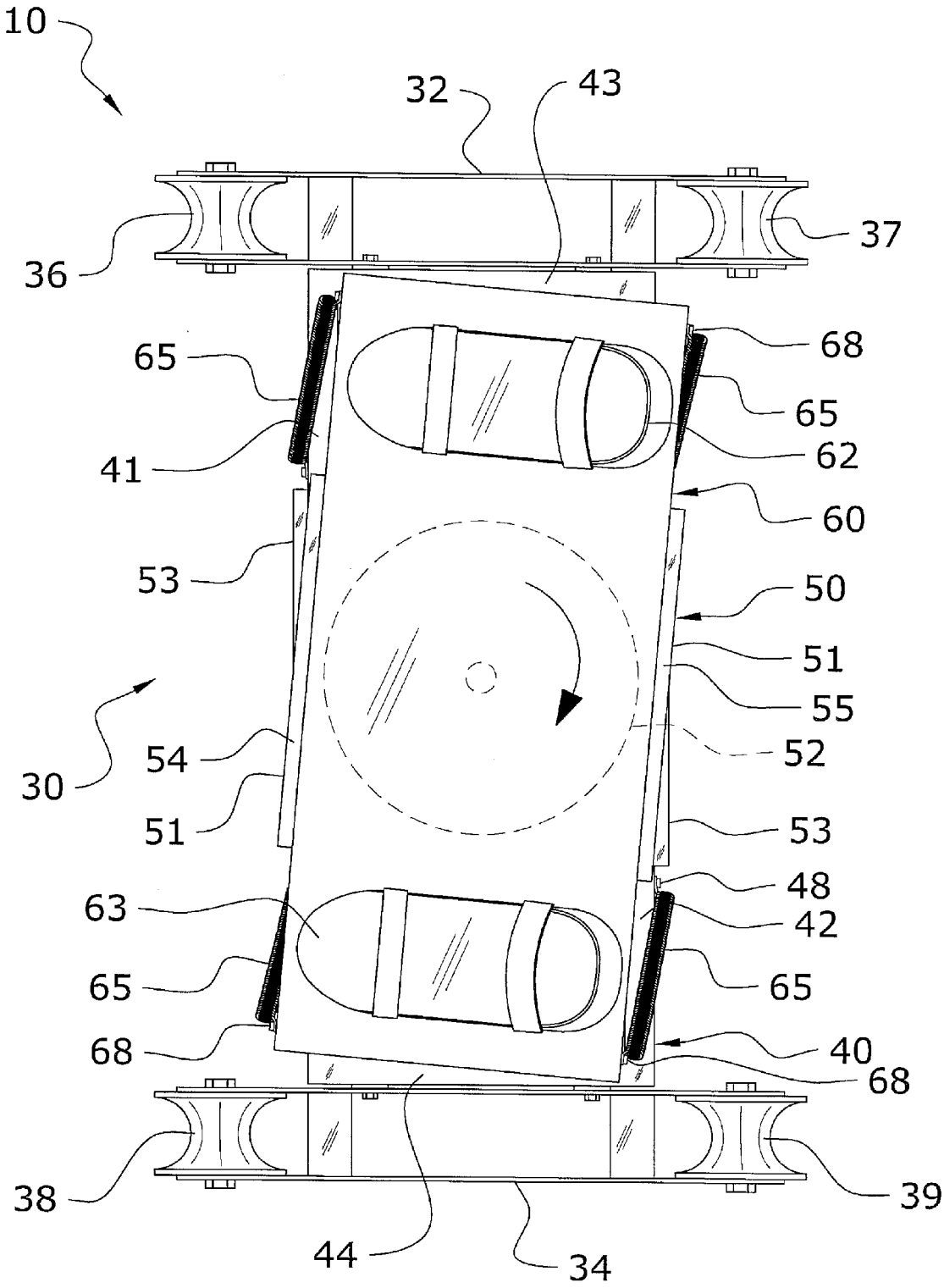
FIG. 8 is a top view of the carriage assembly of the present invention illustrating its pivoting motion.
Figure 9:
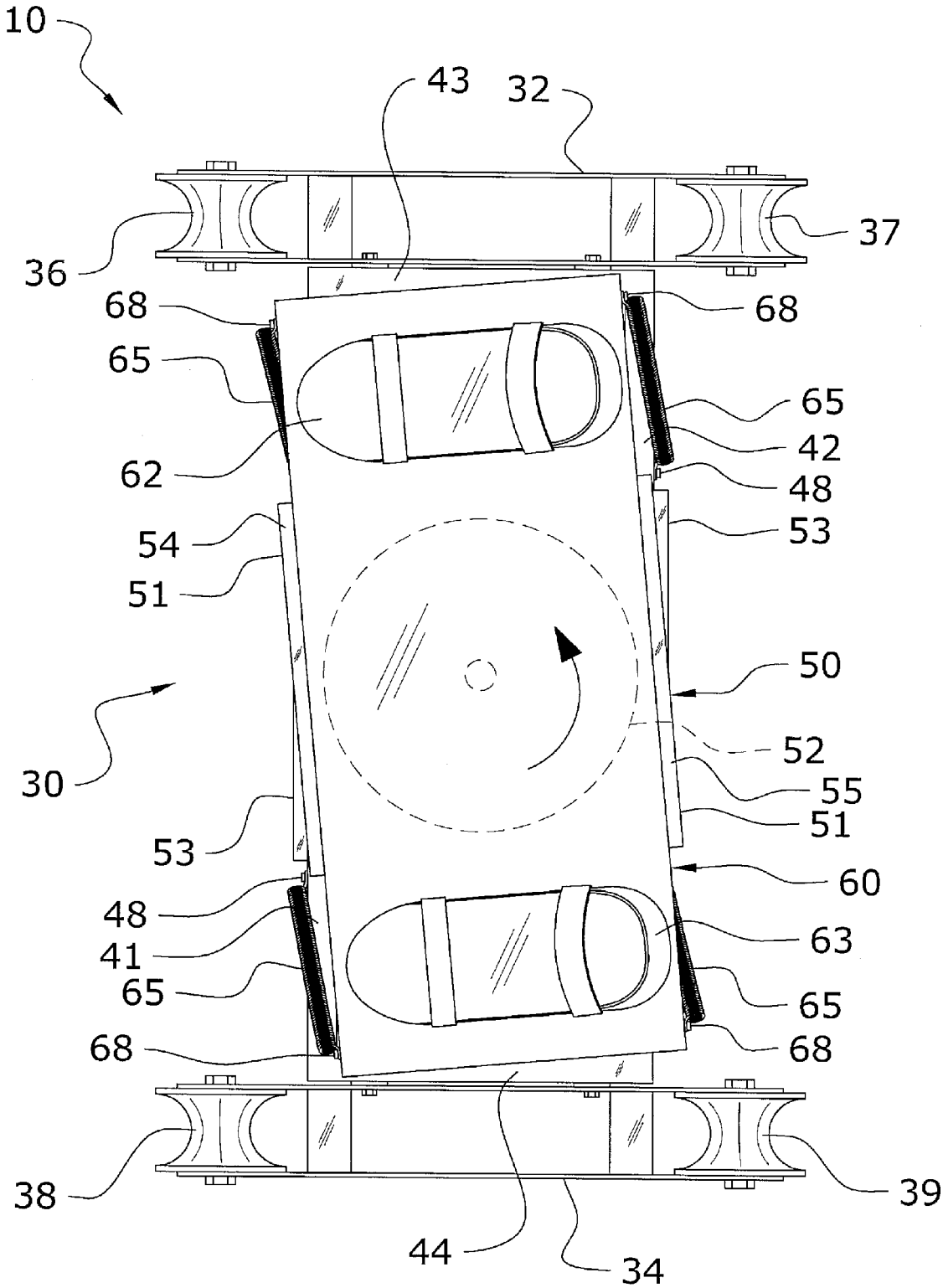
FIG. 9 is a top view of the carriage assembly of the present invention illustrating its pivoting motion.

The carriage assembly 30 will also preferably be configured to freely swivel about a vertical axis of rotation as shown in FIGS. 8 and 9. The swiveling and tilting motions of the carriage assembly 30, which are independent of each other as well as independent of the pendulum movement of the carriage assembly 30 along the tracks 21, 22, increases muscle tone and flexibility in a number of muscles and body areas which are important to boarding sports.

Figure 4:
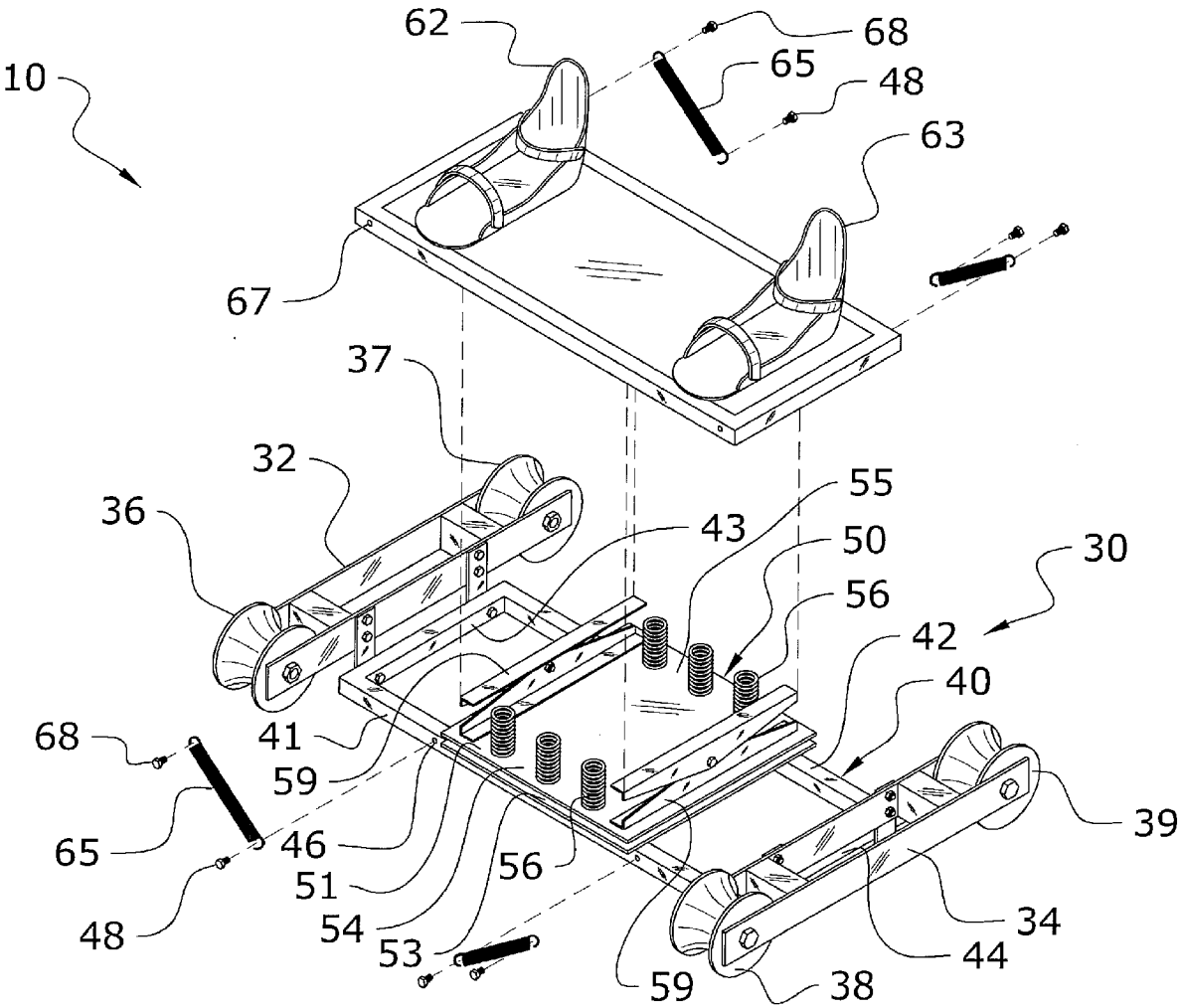
FIG. 4 is an exploded upper perspective view of the carriage assembly of the present invention.

The carriage assembly 30 will generally be slidably connected to the first track 21 and second track 22 through use of a plurality of wheels 36, 37, 38, 39 mounted on a pair of wheel supports 32, 34. In a preferred embodiment, a first wheel support 32 is fixedly mounted on a first side of the carriage assembly 30 and a second wheel support 34 is fixedly mounted on a second side of the carriage assembly 30, wherein the first side is opposite the second side as illustrated in FIG. 4. The wheel supports 32, 34 may be comprised of various configurations which allow the wheels 36, 37, 38, 39 of the present invention to be mounted on either side of the carriage assembly 30. In a preferred embodiment, the wheel supports 32, 34 are each comprised of rod assemblies which are fixedly mounted to either side of the carriage assembly 30 through use of brackets or other fasteners.

It is also appreciated that the frictional engagement between the tracks 21, 22 and the carriage assembly 30 may be adjustable so as to allow a range of resistance for different types of exercisers. For example, the frictional engagement may be lowered for beginning exercisers, or it may be raised for more advanced exercisers looking for a more intense workout.

In a preferred embodiment, the carriage assembly 30 will include four wheels, with two on each side. In such an embodiment, a first wheel 36 and second wheel 37 will be attached to the respective ends of the first wheel support 32 and a third wheel 38 and fourth wheel 39 will be attached to the respective ends of the second wheel support 34 as shown in FIG. 4. However, it is appreciated that more or less wheels may be utilized with the present invention so long as the carriage assembly 30 is capable of freely traversing the first and second tracks 21, 22 of the frame 20. For example, a single wheel may be utilized on each wheel support 32, 34 without affecting the overall operation of the present invention. Additionally, it should be appreciated that in some embodiments the wheel supports 32, 34 may not be included and the wheels 36, 37, 38, 39 may be attached directly to the carriage assembly 30.

The wheels 36, 37, 38, 39 of the present invention may be comprised of any configuration which allows the wheels 36, 37, 38, 39 to freely slide along the first track 21 and second track 22 with minimal resistance. In a preferred embodiment as shown in the figures, the wheels 36, 37, 38, 39 include an indentation along their respective outer surfaces into which the tracks 21, 22 are inserted, wherein the wheels 36, 37, 38, 39 extend partially around the tracks 21, 22; similar to the configuration of train wheels.

The carriage assembly 30 may be comprised of various configurations, but in a preferred embodiment will include a lower support 40, a middle support 50 and an upper support 60 which interact with each other to allow the tilting and swiveling motion of the carriage assembly 30 when in use.

i. Lower Carriage Support

The lower support 40 of the present invention is generally comprised of the base of the carriage assembly 30, to which the first wheel support 32, second wheel support 34 and middle support 50 are attached. The lower support 40 may be comprised of various configurations, though in a preferred embodiment a rectangular frame comprised of four interconnected elongated, rigid members may be utilized as shown in FIG. 4. However, it should be noted that in some embodiments the lower support 40 may be comprised of a plate member or other structure, so long as it provides support for the wheel supports 32, 34 and middle support 50.

The lower support 40 will generally include a first side 41, second side 42, third side 43 and fourth side 44 as shown in FIG. 4. The first side 41 and second side 42 will generally be comprised of the front and rear sides of the lower support 40, respectively. The third side 43 and fourth side 44 will generally be comprised of the respective side members of the rectangular lower support 40.

The first side 41, which will generally be the forward-facing side of the lower support 40, will generally include at least one aperture 46 to which at least one diagonal bias member 65 of the present invention may be attached via at least one fastener 48. The first side 41 of the lower support 40 will also generally act as a first mounting point for the middle support 50 as shown in FIG. 4.

The second side 42, which will generally be the rearward-facing side of the lower support 40, will generally include at least one aperture 46 to which at least one diagonal bias member 65 of the present invention may be attached via at least one fastener 48. The second side 42 of the lower support 40 will also generally act as a second mounting point for the middle support 50 as shown in FIG. 4.

The third side 43 and fourth side 44 of the lower support 40 will also generally include one or more apertures 46 to which the first wheel support 32 and second wheel support 34 may be attached via one or more fasteners 48, respectively. Specifically, in a preferred embodiment, the first wheel support 32 will be fixedly attached to the third side 43 of the lower support 40 via a pair of apertures 46 and fasteners 48. The second wheel support 34 will be fixedly attached to the fourth side 44 of the lower support 40 via another pair of apertures 46 and fasteners 48. However, in some embodiments of the present invention, it is appreciated that the first and second wheel supports 32, 34 may not be used, and instead the first wheel 36 and second wheel 37 may be attached directly to the third side 43 and the third wheel 38 and fourth wheel 39 may be attached directly to the fourth side 44.

ii. Middle Carriage Support

The middle support 50 of the present invention will generally be fixedly attached directly on top of the lower support 40 as shown in FIG. 4. In a preferred embodiment, the front portion 54 of the middle support 50 will be fixedly attached to the first side 41 of the lower support 40 and the rear portion 55 of the middle support 50 will be fixedly attached to the second side 42 of the lower support 40. The middle support 50 will preferably be welded directly onto the lower support 40, though it is appreciated that other means for attaching may be utilized, including the use of fasteners such as bolts. The use of fasteners for attaching the middle support 50 on top of the lower support 40 could be utilized to ease disassembly of the carriage assembly 30 for maintenance or cleaning.

The middle support 50 may be comprised of various configurations, though in a preferred embodiment the middle support 50 will be comprised of an upper plate 51 and a lower plate 53 which are attached on top of each other by a swivel member 52 which allows the upper plate 51 to freely swivel about a vertical axis of rotation on top of the lower plate 53 as shown in FIGS. 8 and 9. The upper plate 51 and lower plate 53 will preferably be comprised of rectangular plate members, though it is appreciated that other shapes and configurations may be utilized so long as a swivel member 52 may be accommodated to effectuate the swiveling motion between the upper plate 51 and lower plate 53.

The swivel member 52 of the present invention will generally be comprised of a circular, flat, plate member which is rotatably attached to the upper surface of the lower plate 53 and fixedly attached to the lower surface of the upper plate 51 such that the upper plate 51 may freely swivel about a vertical axis of rotation with respect to the lower plate 53. In a preferred embodiment, a bearing may be utilized to effectuate the rotational attachment of the swivel member 52 to the upper plate 51, though it is appreciated that other means of attachment may be utilized so long as the upper plate 51 is able to freely swivel about a vertical axis of rotation. It is also appreciated that the swivel member 52 need not be circular in every embodiment of the present invention, as other shapes may be utilized without affecting the swiveling motion of the upper plate 51. While it is preferred that the upper plate 51 be welded to the upper surface of the swivel member 52, it is appreciated that fasteners such as bolts may be utilized to ease disassembly for maintenance or cleaning.

The middle support 50 will also generally include at least one tilt member 58, 59 for allowing the upper support 60 to freely tilt forward and backward about a horizontal axis of rotation. In a preferred embodiment, a first tilt member 58 will be positioned on the edge of the upper plate 51 of the middle support 50 which faces the first wheel support 32 and a second tilt member 59 will be positioned on the edge of the upper plate 51 of the middle support 50 which faces the second wheel support 34 as shown in FIG. 4. However, it is appreciated that less or more tilt members 58, 59 may be utilized with the present invention so long as the upper support 60 is able to freely tilt forward and backward. For example, in some embodiments a single tilt member 58, 59 may be utilized toward the center of the middle support 50 to effectuate the same tilting motion.

The tilt members 58, 59 may be comprised of various configurations which allow one flat member to freely tilt with respect to a second flat member, though it is preferred that a configuration be utilized wherein a base will be fixedly attached to the upper surface upper plate 51 of the middle support 50. An elongated, rigid member will preferably be rotatably attached at its center point to the center point of the tilt member base as shown in FIG. 4. The upper surface of the elongated, rigid member will then be fixedly attached to the lower surface of the upper support 60 so as to allow the upper support 60 to tilt in both a forward and rearward direction.

In order to provide resistance and manage the tilting motion of the upper support 60, one or more vertical bias members 56 may be positioned between the middle support 50 and upper support 60. In a preferred embodiment, the vertical bias members 56 will each be comprised of a spring, though it is appreciated that other elastic members may be utilized so long as some resistance is provided with respect to the tilting motion. Additionally, various types of springs may be utilized without affecting the overall operation of the present invention. It is appreciated that in some embodiments the resistance of the vertical bias members 56 may be adjustable so as to increase or decrease the effort required on the part of an individual in tilting the upper support 60 about a horizontal axis of rotation.

Any number of vertical bias members 56 may be utilized with the present invention, though in a preferred embodiment a row of three vertical bias members 56 will be placed on the front portion 54 of the upper plate 51 of the middle support 50 and a row of three additional vertical bias members 56 will be placed on the rear portion 55 of the upper plate 51 of the middle support 50 as shown in FIG. 4. It is appreciated, however, that more or less vertical bias members 56 may be utilized in various configurations so long as resistance is provided with respect to the tilting motion.

iii. Upper Carriage Support

The upper support 60 of the present invention is generally comprised of a rectangular platform which is fixedly attached at its lower surface to the first tilt member 58 and second tilt member 59 of the present invention as shown in FIG. 4. The upper support 60 may be comprised of various configurations and shapes and, in some embodiments, may be comprised of interconnected elongated members with a space defined therein, as opposed to the platform shown in the figures.

The upper support 60 will generally be the surface on which an operator of the present invention positions his/her feet prior to and during use of the exercise system 10. The upper support 60 will preferably include a first foot binding 62 and a second foot binding 63 fixedly attached to its upper surface as shown in FIG. 1. The foot bindings 62, 63 may be comprised of various known bindings for feet, including boots, shoes, sandals and the like which are fixedly attached to the upper surface of the upper support 60. In a preferred embodiment, ski shoes may be utilized so as to better simulate board sports when using the present invention. It is also appreciated that in some embodiments the foot bindings 62, 63 may be removably attached to the upper support 60. Such an embodiment would allow multiple people to utilize the present invention even though they may have different foot sizes. With such an embodiment, foot bindings 62, 63 of a first size may be removed from the upper carriage assembly 60 and replaced with foot bindings 62, 63 of a second size to accommodate a second person. In any case, the foot bindings 62, 63 should securely hold the operator's feet in place on the upper support 60 so as to prevent the operator's feet from slipping or becoming dislodged during use of the present invention.

The upper support 60 will generally be connected to the lower support 40 via one or more diagonal bias members 65 as shown in FIG. 4. The diagonal bias members 65 act to provide resistance and manage the swiveling motion of the carriage assembly 30 when the present invention is in use. In a preferred embodiment, the diagonal bias members 65 will each be comprised of springs, though it is appreciated that various other elastic members may be utilized. Additionally, various types of springs may be utilized without affecting the overall operation of the present invention. It is appreciated that in some embodiments the resistance of the diagonal bias members 65 may be adjustable so as to increase or decrease the effort required on the part of an individual in swiveling the upper support 60 about a vertical axis of rotation.

The upper support 60 will preferably include one or more apertures 67 to which the diagonal bias members 65 may be attached via one or more fasteners 68 as shown in FIG. 4. In a preferred embodiment, four diagonal bias members 65 will be utilized; two connecting the front edge of the upper support 60 to the front edge of the lower support 40 and two connecting the rear edge of the upper support 60 to the rear edge of the lower support 40. Preferably, a first end of each diagonal bias member 65 will be attached to the lower support 40 via an aperture 46 and fastener 48, and a second end of each diagonal bias member 65 will be attached to the upper support 60 via an aperture 67 and fastener 68.

D. Operation of Preferred Embodiment

In use, an operator of the present invention secured one foot in the first foot binding 62 and a second foot in the second foot binding 63. The operator then grasps the first handrail 23 and second handrail 24 with his/her hands and begins swinging his/her legs forward and backward, causing the carriage assembly 30 to slide forward and backward along the first track 21 and second track 22. The operator may swivel his/her feet about a vertical axis of rotation through use of the swivel member 52 and may tilt his/her feet about a horizontal axis of rotation through use of the tilt member 58, 59 to increase toning of the lower leg muscles. By sliding the carriage assembly 30 along the tracks 21, 22 and utilizing the swiveling and tilting motions, the operator may simulate the motions and exercises encountered while enjoying boarding sports such as, snowboarding, surfing, wakeboarding, windsurfing, kiteboarding and skateboarding.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An exercise system, comprising:

a frame including at least one track, wherein said at least one track is comprised of a curved structure, wherein said at least one track is comprised of a first and a second track, wherein said frame includes a first handrail and a second handrail, wherein said first handrail links a first end of said first track to a second end of said first track, wherein said second handrail links a first end of said second track to a second end of said second track; and a carriage assembly slidably mounted on said at least one track such that said carriage assembly slides along said at least one track in a curved manner, wherein said carriage assembly tilts about a horizontal axis of rotation, wherein said carriage assembly includes an upper surface adapted for an exerciser to stand upon.

2. The exercise system of claim 1, wherein said first track runs parallel to said second track.

3. The exercise system of claim 1, further comprising a first foot binding and a second foot binding attached to said upper surface of said carriage assembly, wherein said first foot binding and said second foot binding are each positioned parallel to said at least one track.

4. The exercise system of claim 1, wherein said carriage assembly swivels about a vertical axis of rotation.

5. The exercise system of claim 1, wherein said carriage assembly includes at least one wheel that engages with said at least one track.

6. The exercise system of claim 5, wherein said carriage assembly includes a first wheel support and a second wheel support, wherein said at least one wheel is comprised of a first wheel, a second wheel, a third wheel and a fourth wheel, wherein said first wheel support includes said first wheel and said second wheel, wherein said second wheel support includes said third wheel and said fourth wheel.

7. The exercise system of claim 1, wherein said carriage assembly includes an upper support and a lower support, wherein said upper support and said lower support are pivotally attached such that said upper support tilts about a horizontal axis of rotation.

8. The exercise system of claim 7, including at least one bias member attached between said lower support and said upper support.

9. The exercise system of claim 8, wherein said at least one bias member is positioned perpendicularly with respect to an upper surface of said lower support.

10. The exercise system of claim 9, wherein said at least one bias member is comprised of a spring.

11. An exercise system, comprising:

a frame including at least one track, wherein said at least one track is comprised of a curved structure; and a carriage assembly slidably mounted on said at least one track such that said carriage assembly slides along said at least one track in a curved manner, wherein said carriage assembly swivels about a vertical axis of rotation, wherein said carriage assembly includes an upper surface adapted for an exerciser to stand upon, wherein said carriage assembly includes a lower support, a middle support and an upper support, wherein said middle support is attached to an upper surface of said lower support, wherein said middle support is comprised of an upper plate and a lower plate connected by a swivel member.

12. The exercise system of claim 11, wherein said at least one track is comprised of a first track and a second track, wherein said first track runs parallel to said second track.

13. The exercise system of claim 11, further comprising a first foot binding and a second foot binding attached to said upper surface of said carriage assembly, wherein said first foot binding and said second foot binding are each positioned parallel to said at least one track.

14. The exercise system of claim 12, wherein said carriage assembly tilts about a horizontal axis of rotation.

15. The exercise system of claim 11, wherein said upper support and said lower support are pivotally attached.

16. The exercise system of claim 15, wherein said upper support swivels about a horizontal axis of rotation.

17. The exercise system of claim 16, wherein at least one bias member is connected at one end to said lower support and at another end to said upper support.

18. The exercise system of claim 17, wherein said at least one bias member is diagonally oriented.

19. The exercise system of claim 18, wherein said at least one bias member is comprised of a spring.

20. An exercise system, comprising:

a frame including a first track and a second track, wherein said first track and said second track are comprised of a curved structure, wherein said first track runs parallel to said second track, wherein said first track and said second track are each comprised of a concave configuration, wherein said frame includes a first handrail and a second handrail, wherein said first handrail links a first end of said first track to a second end of said first track, wherein said second handrail links a first end of said second track to a second end of said second track;

a carriage assembly slidably mounted on said at least one track such that said carriage assembly slides along said at least one track in a curved manner, wherein said carriage assembly tilts about a horizontal axis of rotation, wherein said carriage assembly swivels about a vertical axis of rotation;

wherein said carriage assembly includes a lower support, a middle support and an upper support, wherein said middle support is attached to an upper surface of said lower support, wherein said middle support is comprised of an upper plate and a lower plate connected by a swivel member;

at least one diagonal bias member connected at one end to said lower support and at another end to said upper support;

at least one vertical bias member connected at one end to said middle support and at another end to said upper support;

at least one tilt member attached to an upper surface of said middle support, wherein a lower surface of said upper support is attached to said at least one tilt member;

a first foot binding and a second foot binding attached to an upper surface of said upper support, wherein said first foot binding and said second foot binding are each positioned parallel to said first track and said second track;

a first wheel support attached to a first side of said carriage assembly, wherein said first wheel support includes a first wheel and a second wheel; and a second wheel support attached to a second side of said carriage assembly, wherein said second wheel support includes a third wheel and a fourth wheel.

* * * * *